United States Patent [19]

Browning

[11] Patent Number: 4,568,019

[45] Date of Patent: Feb. 4, 1986

[54] INTERNAL BURNER TYPE FLAME SPRAY METHOD AND APPARATUS HAVING MATERIAL INTRODUCTION INTO AN OVEREXPANDED GAS STREAM

[76] Inventor: James A. Browning, P.O. Box 6, Hanover, N.H. 03755

[21] Appl. No.: 602,571

[22] Filed: Apr. 20, 1984

Related U.S. Application Data

[63] Continuation-in-part of Ser. No. 583,474, Feb. 24, 1984.

[51] Int. Cl.[4] ..... B05B 1/24

[52] U.S. Cl. ..... 239/13; 239/80; 239/83; 239/84

[58] Field of Search ..... 239/1, 8, 13, 79–81, 239/83–85; 219/76.13, 76.16, 121 PL, 121 PY

[56] References Cited

U.S. PATENT DOCUMENTS

| | | | |
|---|---|---|---|
| 2,092,150 | 9/1937 | Bleakley | 239/83 X |
| 2,414,181 | 1/1947 | Vandersee | 238/80 |
| 2,950,867 | 8/1960 | Hawley et al. | 239/79 X |
| 3,030,982 | 4/1962 | Navara | 239/79 X |
| 3,312,566 | 4/1967 | Winzeler et al. | 219/76.16 X |
| 3,892,882 | 7/1975 | Guest et al. | 239/81 X |
| 4,231,518 | 11/1980 | Zverev et al. | 239/81 |
| 4,370,538 | 1/1983 | Browning | 239/81 X |

*Primary Examiner*—Jeffrey V. Nase

*Assistant Examiner*—Mary Beth O. Jones

*Attorney, Agent, or Firm*—Sughrue, Mion, Zinn, Macpeak, and Seas

[57] ABSTRACT

The products of combustion of compressed air and fuel fed to an internal burner issue through one or more orifices into a single large diameter expansion or nozzle bore open to the atmosphere. Solid rod or solid particle material to be sprayed is passed concurrent with the products of combustion through the large diameter chamber with the material being heat softened or melted to form a spray which is impacted against a workpiece after acceleration to high velocity. The pressure within the large diameter chamber is maintained sub-atmospheric. By aspirating atmospheric air flow bearing particulate material or by leaking air about a solid rod to the sub-atmospheric chamber pressure, pre-melting of the wire or particulate material within the material feed passage upstream of the chamber and prevented via hot combustion product gas back flow. Gas flow asymmetrically into an axial particle stream or solid rod within the large diameter chamber may be effected without liquid melt material deposit on the chamber bare wall. Alternatively, material in powder form may be introduced asymmetrically into an axial flow of the products of combustion through the large diameter expansion chamber.

14 Claims, 3 Drawing Figures

INTERNAL BURNER TYPE FLAME SPRAY METHOD AND APPARATUS HAVING MATERIAL INTRODUCTION INTO AN OVEREXPANDED GAS STREAM

This application is a continuation-in-part of application Ser. No. 583,474 filed Feb. 24, 1984, entitled "IMPROVED COMPRESSED AIR AND FUEL OPERATED FLAME SPRAY METHOD AND APPARATUS", now abandoned.

FIELD OF THE INVENTION

This invention relates to flame spray methods and apparatus, and more particularly to a flame spray system utilizing the products of combustion from an internal burner derived from combusting compressed air and fuel or an oxy-fuel mixture therein, in which solid material is introduced into the combustion gas stream while in overexpanded condition, outside of the combustion chamber.

BACKGROUND OF THE INVENTION

Internal burners operated on compressed air and fuel have not been used in the commercial flame spray field. Present flame spray systems use expensive pure oxygen or even electricity to create a flame spray jet stream for accelerating particle movement while melting the particles prior to impact on a substrate downstream of the flame spray apparatus.

Internal burners for use with compressed air are cumbersome and are large in size, and the exit flame-jet from a single outlet nozzle cannot be readily placed coaxially with injected powder or solid wire or rod material to be flame sprayed by the apparatus.

My U.S. Pat. No. 4,416,421 is directed to a flame spray method and apparatus wherein pure oxygen and a fuel mixture continuously flowing to and confined within an essentially closed internal burner combustion chamber creates relatively high pressure hot combustion product gases which are directed through a flow expansion nozzle as a high velocity gas stream at one end of the combustion chamber. Material in solid rod form or as solid particles is fed to the hot gas stream outside of the combustion chamber and axially into a converging flow of the hot combustion product gases, after exit from the combustion chamber, and while entering a converging portion of a flow expansion nozzle whose length is at least five times that of the nozzle bore throat. Thus, the material can be heat softened or liquified and sprayed at high velocity onto a surface positioned in the path of the stream at the discharge end of the nozzle. This results in a restriction of the diameter of the column of particles passing to the nozzle bore, the prevention of build up of particle material on the nozzle bore wall while insuring sufficient particle dwell time within the bore to effect particle heat softening or melting and flow at supersonic flow velocity prior to impact against the surface.

The present invention further provides an improvement over my copending U.S. patent application Ser. No. 571,775 filed Jan. 18, 1984. In application Ser. No. 571,775, the material to be flame sprayed is introduced in a supersonic flow stream prior to passing with the stream through a nozzle of extended length. In such application, flow pressures are always greater than atmosphere at the point of introduction of the solid material in either powder or rod form to the reactant products of combustion and the reactants constitute oxygen and fuel continuously supplied to the internal burner.

Introducing the solid material in powder or rod form into the hot flowing product of combustion gases at a zone of sub-atmospheric gas pressure has distinct advantages. Reactants of compressed air and fuel permit the successful melting of lower melting point materials such as aluminum, zinc, copper, and flame spraying of these materials at substantially reduced cost relative to the oxy-fuel mixture which is necessary when melting and spraying higher melting point materials such as stainless steel, mild steel, nickel, chrome alloys, and the like.

In flame spray systems, in order to prevent build up of the material being flame sprayed, after melting or after being rendered semi-molten, conventionally such material in either rod or powder form is introduced axially into the hot products of combustion gas stream which in itself is delivered to the nozzle under conditions of flow symmetry, as in U.S. patent application Ser. No. 571,775, thereby tending to maintain the particles within the core of the gas stream, while accelerating the stream of particles to supersonic velocity prior to impact against a substrate downstream from the exit of the nozzle itself.

It is a primary object of the present invention, in one form, to provide an improved compressed air and fuel flame spray method and apparatus which permits compressed air to be employed as an element of the fuel mixture within an internal burner, which effectively permits large scale flame spraying of lower melting point materials with huge cost savings by eliminating the necessity to employ expensive pure oxygen and which results in high material deposition rates, produces dense coatings and which inherently eliminates back flow of the products of combustion into the material feed mechanism.

It is a further object of the present invention to provide an improved flame spray method and apparatus of the internal burner type in which either a continously flowing compressed air and fuel mixture or a pure oxygen and fuel mixture is ignited within a combustion chamber, and wherein solid material in powder or rod form is introduced into the products of combustion, outside of the internal burner combustion chamber, at sub-atmospheric pressure after the gas overexpanded, with either the gas or the material, if in powder form, introduced symmetrically or asymmetrically without particle build up along the nozzle wall.

SUMMARY OF THE INVENTION

The improved flame spray apparatus of the present invention in one form permits high deposition rate particle coating of a substrate downstream of the apparatus. The apparatus comprises an internal burner forming an essentially closed combustion chamber. Means are provided for continuously combusting a flow of compressed air and fuel or pure oxygen and fuel within the internal burner combustion chamber. A block closing off the internal burner includes a relatively large diameter, expansion chamber terminating in an exit port opening outwardly of the block at one end thereof. Products of combustion passage means connect the combustion chamber to the large diameter expansion chamber and open to the large diameter chamber at the end, opposite the expansion chamber exit port. At least one material feed passage means within the block opens to the large diameter chamber at the end of the chamber remote from said exit port. Means are provided for feeding a material to be sprayed onto the substrate through the at least one material feed passage means. In one form, the orifice area of the passage means connecting the combustion chamber to the large diameter chamber and the minimum diameter of the large diameter chamber at the exit port are such that the pressure within the large diameter is sub-atmospheric and the material to be melted is accelerated by the products of combustion passing through the large diameter chamber to high velocity and the material is melted to effect particle coating of the substrate at low cost under extremely high deposition rates with the particles melting downstream of the large diameter chamber well after discharge from said at least one material feed passage means. The sub-atmospheric pressure therein prevents backflow of the products of combustion from the internal burner into the material feed passage means. The material feed passage means may comprise a plurality of inclined passages extending longitudinally through a block and converging towards the large diameter passage chamber. In one form, the large diameter expansion chamber is conical and converges in the direction of flow of the products of combustion. A pair of side-by-side passages within the block extend parallel to the combustion chamber, open to the chamber at right angles and are at right angles and to opposite sides of the material feed passage means. Parallel, inclined converging holes within the block to opposite sides and above and below the material feed passage means open to the side by side passages and the large diameter chamber so as to be equally spaced on the diagonal relative to the conical large diameter converging chamber and have a common angle of inclination with the conical surface of the chamber. In another form, the expansion chamber takes the form of an elongated expansion nozzle bore, and gas or material feed is asymmetrical.

DESCRIPTION OF THE PREFERRED EMBODIMENTS

Figure 1:
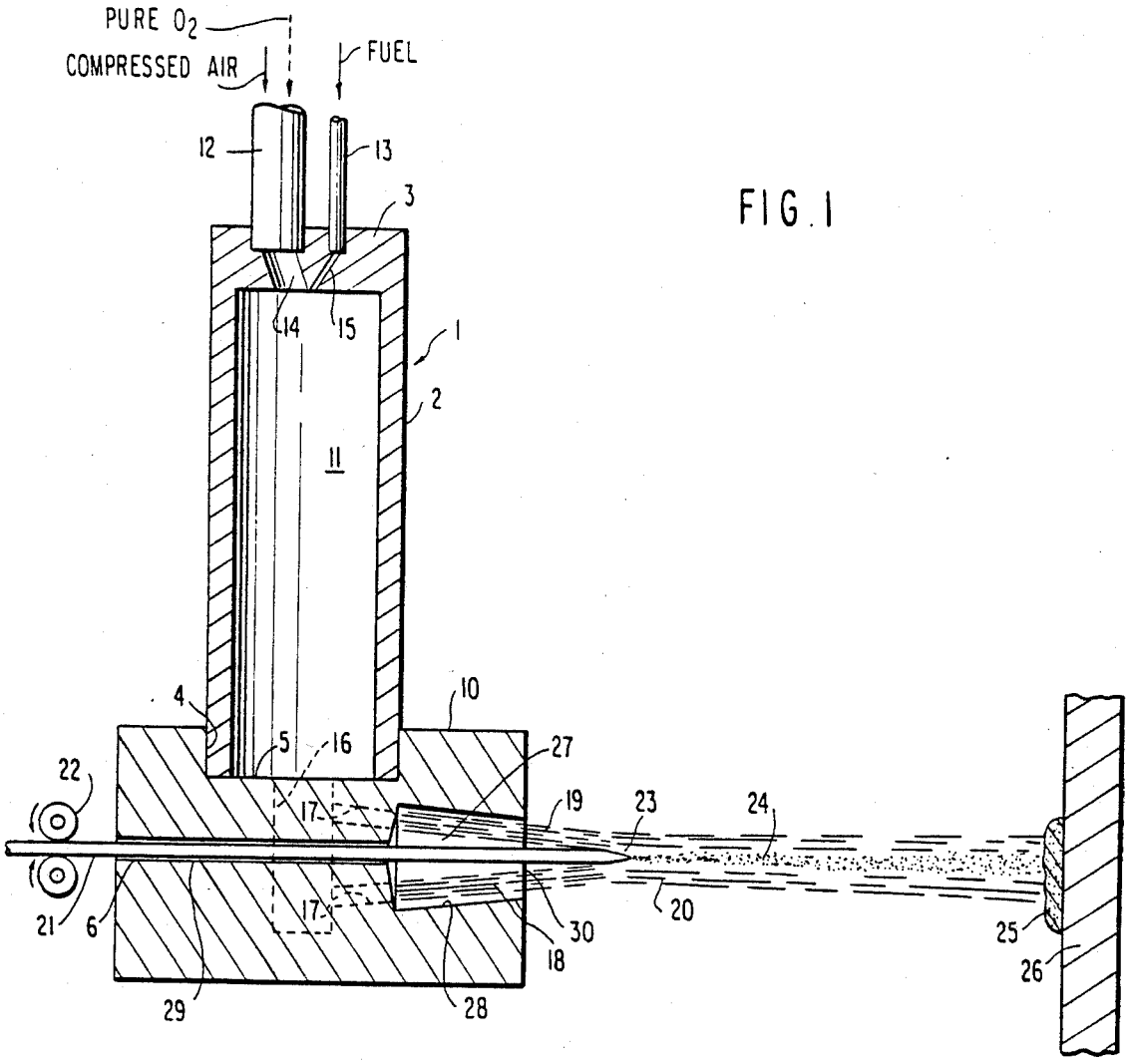
FIG. 1 is a longitudinal, sectional view of one embodiment of the improved flame spray apparatus of the present invention.

Referring to FIG. 1, there is illustrated in longitudinal, vertical sectional form, and somewhat schematically, the main elements of the improved flame spray apparatus of the present invention, constituting one embodiment thereof. An internal burner type flame spray apparatus is indicated generally at 1, constituting an internal burner, and is formed principally of a rectangular block 10 bearing a circular bore as at 4 within one face thereof, which bore sealably, fixably receives a hollow cylindrical metal member 2 closed at its opposite end by end wall 3 and forming, with the block 10, the combustion chamber 11 of the internal burner. Cylinder 2 abuts the bottom 5 of the bore 4 such that block 10 closes off that end of the combustion chamber 11. A first, relatively large diameter tube 12 is mounted to end wall 3 and is axially aligned with and open to an oblique air supply passage 14, passage 14 opening to the combustion chamber 11 at that end. A second tube 13 functions to supply fuel, as indicated by the arrow so labeled, to the combustion chamber 11, tube 13 opening to a small diameter inclined passage 15 which intersects passage 14 at the combustion chamber. The fuel, which may be in either liquid or gas form, and which may, for instance, comprise a No. 2 fuel oil, is aspirated into the air stream entering through the larger diameter passage 14 from a compressed air supply, indicated by the arrow so labeled. Alternatively, pure oxygen, under pressure, may replace the compressed air. If necessary or if advantageous, tube 12 may also receive pure oxygen under pressure as indicated by the arrow so labeled. The fuel, air mixture may be ignited by sparking such as a spark plug (not shown) at the end of the chamber 11 bearing passages 14, 15. The fuel and air are supplied continuously so that continuous combustion occurs within the combustion chamber 11.

The products of combustion flow into two, equal, side by side manifold passages 16 constituting extensions of bore 4 which are parallel therewith but do not project completely through block 10. Four inclined passages as at 17, two for each of the manifold passages 16 open to those manifold passages at one end and at their other ends open to a conically reducing volume or large diameter expansion chamber 27 which chamber 27 opens at one end of the block forming exit port 30, facing a substrate or support 26. The diameter of chamber 27 is sufficiently large that the four individual jets of hot products of combustion entering the chamber 27 from inclined, converging passages 17 pass along the conical, converging wall 28 of the chamber without filling the entire chamber volume. The passages 17 are generally aligned with the converging conical wall 28 of chamber 27.

Purposely, a longitudinal bore 29 extends the length of block 10, being coaxial with chamber 27 and passing betwen the vertical manifold passages 16. As may be appreciated, with the products of combustion from chamber 11 causing the four individual jets 18 to pass along the wall 28, a strong aspirating action occurs which would draw air from the atmosphere to the left of block 10, FIG. 1, through passages 29 under conditions were wire or rod 29 not positioned within the hole 29 for passage into the chamber. Purposely, the diameter of passage or hole 29 may be slightly larger than the diameter of the wire or rod 21, so that there is a continuous aspiration of some air from the atmosphere through the hole during the flame spray operation. Wire 21 passes through hole 29 by being forcibly driven by means (not shown) via rotation of rolls 22, in the direction of the arrows adjacent thereto, FIG. 1, causing the wire 21 to pass axially of and within the combined flame jet 20. The individual jets 18 merging into a common or combined flame jet 20 at or downstream of the end of dfownstream large diameter chamber 27. The wire or rod 21 is heated, melted and atomized at point 23 downstream of chamber 27 to form the liquid droplet spray 24. The spray particles are accelerated to ultrasonic velocity by stream 20 and strike the workpiece to form coating 25.

Water cooling is normally required but the water cooling passages within block 10 and cylinder 1 forming combustion chamber 11 are purposely deleted from the schematic representation to eliminate complications of the figure, but such water cooling may be employed as in the manner illustrated in my earlier U.S. Pat. No.

4,416,421, and under an arrangement which is well known in the art.

In looking into the chamber 27 from the right, FIG. 1, the four holes 17 are equally spaced on the diagonal and pairs emanate from the top and bottom of vertical passages 16, to the left and right of wire 21.

It is the essence of the invention that operating parameters and variables be so selected as to cause an aspirating action which is necessary to successful operation of the flame spray apparatus and its method of operation. For a given reactant flow (air and fuel) at a given combustion pressure and total orifice area of the four holes 17, there is a minimum diameter for exit port 30 of chamber 27 for block 10 below which the pressure in chamber 27 climbs above that of the atmosphere.

A pressure higher than atmospheric results in a reverse flow of extremely hot gases through the wire delivery hole 29. This can result in actual melting of the wire 21 within passage 29, unless the passage 29 is maintained at a pressure greater than that in chamber 7. Such pressurization requires a flow gas along passage 29 to prevent this back flow. Even under such circumstances, leakage of a gasket or a stoppage of the wire motion can cause melting of the wire 21 within passage 29 which can lead to harmful results.

By keeping the pressure in chamber 27 below that of the atmosphere, a backflow of hot gases into passage 29 can never result. In fact, the wire 21 exiting hole 29 initially enters a cool region just downstream of the end of hole 29. If the wire motion halts, the wire melts away from point 23 back towards the hole 29 but terminates at a point well beyond the hole 29, within chamber 27.

Figure 2:
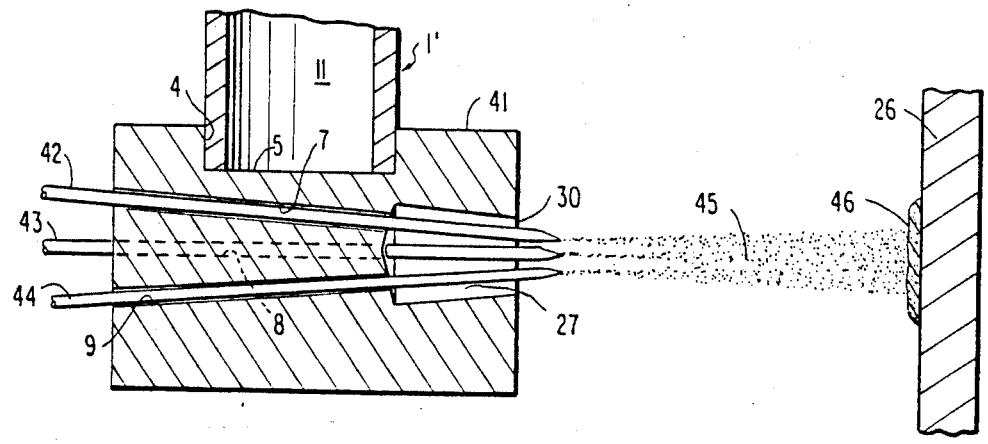
FIG. 2 is a longitudinal, sectional view of an alternate embodiment of the improved flame spray apparatus of the prsent invention.

It should be appreciated that the wire 21 may be replaced while continuing operation of the burner, that is, continuing the combustion of the continuously fed air and fuel mixture within combustion chamber 11. The present invention permits the use of several wires being fed at the same time as may be seen by reference to FIG. 2 which shows an alternate embodiment of the invention. In FIG. 2, like elements bear like numerical designations to those of FIG. 1. The flame spray apparatus 1' in FIG. 2 is comprised of a block 41 which is similar to block 10 of the first embodiment, and utilizes an internal burner identical to that shown in the first embodiment. In FIG. 2, only the lower portion of cylinder 2 is shown, i.e. that portion at or within bore 4, whose end is seated against the bottom 5 of that bore. Purposely in this case, passages 16 and holes 17 are not shown but may be identically formed to the embodiment of FIG. 1. The block 41 includes an outwardly converging relatively large diameter chamber 27 identically sized and configured to that of the embodiment of FIG. 1. Exemplary, an air fuel burner having a chamber 7 whose minimum dimension at exit port 30 is about one inch for adequate aspiration can efficiently provide heat to several wires at the same time as illustrated in FIG. 2. In this case, a series of converging small diameter holes or wire feed passages 7, 8 and 9 are formed within the block passing completely through the block and opening into chamber 27 to permit wires or rods 42, 43 and 44 to concurrently pass through the block and into chamber 27, being fed by rollers (not shown) in a similar manner to rollers 22 of the first embodiment. The flame jet (not shown) identical to that at 20 in FIG. 1 downstream of large diameter converging chamber 27 melts and atomizes the wires to form individual material droplet spray columns which expand and form a single large spray as at 45. A fourth wire adds to that spray but is not shown in the sectional view of FIG. 2. The single large spray of melted material particles impact against the substrate 26 to form a deposit 46 in the manner of the first embodiment.

By test, it has been determined that if the wires are not allowed to touch each other, four wire sprays are initiated at a rate four times that of any single wire. In this way, very large deposition rates become possible, under circumstances in which similar to the first embodiment, the maintenance of sub-atmospheric pressure within converging chamber 27 insures the prevention of wires 42, 42, 44 melting back and into their feed holes or passages 7, 8 and 9, respectively, and/or the back flow of hot combustion product gases through those passages. It is suggested, where a large total amount of spray coating is to be produced, to stagger the wire holding reels (not shown) so that one reel may be replaced while the others are feeding wires during continuous spraying by the apparatus 1'.

It is necessary to employ several wires, rather than a single larger diameter wire, as the combined heat transfer area (flame to wire) of the four smaller wires is significantly greater. In wire spraying, it is important that a fine spray be produced steadily from the tip of the heated wire. Above a certain diameter, the wire melts off in large hunks rather than forming a spray of relatively small molten droplets.

In a typical example where 150 CFM of compressed air feeds to the combustion chamber 11 and is burned with six gallons/hr of No. 2 fuel oil at a chamber 11 pressure of about 100 psig, the exit port 30 of minimum diameter to insure sub-atmospheric pressure within chamber 27 is one inch. For aluminum wire, even melt-off occurs for a maximum wire diameter of a one-eighth of an inch. Using a large diameter three-sixteenths of an inch aluminum wire resulted in a spray stream which was unsteady. It was noted that frequent lumps break off the end of the three-sixteenths of an inch wire under common operating conditions.

It should be appreciated that in contrast to my prior U.S. Pat. No. 4,416,421, while there is some concentration or focussing effect by the inclination of passages 17 and the converging of the individual flame sprays at 18, the effect and purpose here is not to prevent deposit of material on the wall of chamber 27. In fact, chamber 27 is not equatable to the extended length nozzle bore of the spray apparatus nozzle bore of my prior U.S. Pat. No. 4,416,421. As may be appreciated, melting of the solid rod or wire 21 or the multiple wires such as wires 42, 43, and 44 in the two illustrated embodiments of FIGS. 1 and 2, respectively, does not occur until the wires or rods are downstream of chamber 27 of the spray apparatus block 10.

It should also be kept in mind that while the invention has been described in relation to a wire feed system, the principles and the apparatus shown are equally applicable to a system in which a powder flow replaces the solid wire or rod constituting the material supply.

Where a single passage such as passage 29 or multiple passages such as passages 7, 8 and 9 are employed for feeding material to large diameter chamber 27 and into the flow stream of the products of combustion passing through the chamber, feed passages may feed particulate material in which the particles are subsequently melted, accelerated and impacted on substrate 26 downstream of the apparatus 1 or 1'. Conveniently, hoppers bearing such particle form material are positioned above the passage or passages and feed directly to the passages. The hoppers may be open to the atmosphere so that under operating conditions, with chamber 27 at subatmospheric pressure, aspiration of the particles through the passage 29 or passages 7, 8 and 9 would readily occur and under conditions in which there would be inherently no back flow of gases. Under those conditions, the particles would be aspirated into the chamber and through the chamber with the particles melting, depending upon the point where they contact the separate jet streams 18.

Alternatively, a low pressure gas stream could feed powder through such passages. It has been determined that particles melt approximately in the vicinity of point 23, FIG. 1, that is, downstream from the exit port 30 for chamber 27 formed within block 10 or 41.

Additionally, air as the oxidizer can be used alone with the fuel to create the products of combustion capable of spraying aluminum, zinc and even copper and achieving the melting of these materials prior to impact on the substrate 26. For higher melting point materials characterized by steels, nickel alloys and the like, some oxygen enrichment is required. In that case, pure oxygen as indicated by the labeled arrow of FIG. 1 is supplied to the combustion chamber 11 along with a major flow of compressed air and, of course, the fuel. In that case, the compressed air and oxygen may be fed commonly through tube 12 and passage 14 to the combustion chamber 11.

Figure 3:
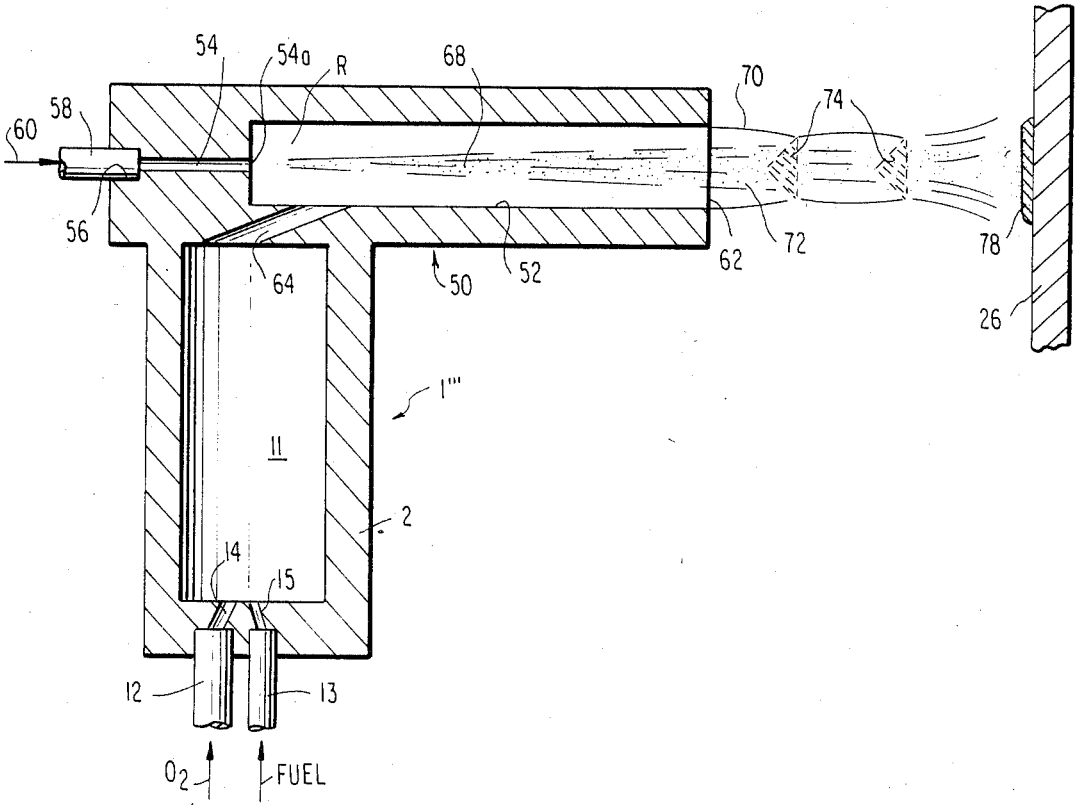
FIG. 3 is a longitudinal, sectional view of a further embodiment of the improved flame spray apparatus of the present invention.

Referring to FIG. 3, a third embodiment of the present invention is illustrated, indicated generally at 1''', and wherein certain like elements to that of the first embodiment bearing like numerical designations. The apparatus 1''' constitues a gun type flame spray unit including a metal cylinder 2 closed off at its ends and forming a combustion chamber 11 of given volume within which the reactants are burned. Oxygen under pressure, as indicated by the arrow so labeled, feeds through tube 12 mounted to the end of cylinder 2 with the oxygen passing through a smaller diameter injector hole 14 into the combustion chamber 11. Fuel, which may be either gas or liquid, as indicated by the arrow so labeled, passes into the combustion chamber 11 through a fuel supply tube 13, entering chamber 11 via a smaller diameter inclined injector hole 15 such that the flows of oxygen and fuel intersect internally of the combustion chamber 11.

At the opposite end of the combustion chamber 11, a large metal nozzle, or block, indicated generally at 50 is integrated to the cylinder 2 at that end which nozzle 50 is of extended length. Nozzle 50 includes a relatively large diameter expansion chamber or bore 52 within which the products of combustion expand. A small diameter material feed passage or inlet hole 54, opening to bore 52, permits the feed of particulate or solid rod material to be flame sprayed against substrate 26 downstream of the exit 62 of bore 52 of the nozzle 50 to enter the expansion bore 52. A particle supply tube 58 has its end received within a hole 56 within the left end of nozzle 50 such that the tube is aligned with the small diameter material feed passage or inlet hole 54. Particulate material feeds as indicated schematically by arrow 60 through the particle supply tube 58 under light pressure where it passes readily through small diameter bore 54 into the large expansion bore 52 of the nozzle. The nozzle bore 52 has a cross-sectional area for gas flow many times that of one or more diagonal or inclined gas transfer passages 64 which communicate the combustion chamber 11 to the flow expansion bore 52 of nozzle 50. In order to effect operation of the apparatus illustrated, the ratio of the nozzle bore 52 to the gas transfer passage 64 areas must be sufficiently large to produce a zone of subatmospheric pressure within the expansion bore 52 of nozzle 50 adjacent the exit end 54*a* of the material feed passage or inlet hole 54.

In the illustrated embodiment, the feed powder, indicated schematically at 60 and shown physically at 68 within the expansion bore 52 of the nozzle 50 flows axially through the nozzle expansion bore 52. While a single transfer passage 64 is shown as extending through the wall of the nozzle 50 from combustion chamber 11 to nozzle expansion bore 52, other configurations are possible including multiple passages from the combustion chamber 11 to the expansion bore 52.

For a sufficiently high combustion chamber pressure for chamber 11, the hot products of combustion gas pass through passage 64 where they overexpand within nozzle expansion bore 52 to reach supersonic flow velocity at sub-atmospheric pressure. This condition is termed "overexpansion". Upon leaving the exit end 62 of the expansion bore 52, and passing into the free atmosphere, the flow constricts slightly as indicated by boundary 70. Further, shock diamonds 74 are evident and are caused by the unbalanced pressure condition of the supersonic gas flow relative to the surrounding atmosphere.

The gas flow feeding the powder through material inlet hole or passage 54 expands into the sub-atmospheric region R at the entrance to nozzle expansion bore 52 with little or no recirculation of particles within the expanded volume formed by expansion bore 52 of nozzle 50. As a result, the particles 68 pass through the full length of the nozzle expansion bore 52 without causing build up on the nozzle bore wall. The powder becomes heat-softened or completely melts and is accelerated to high velocity prior to striking the workpiece or substrate 26 to form a deposited coating 78.

As in the other embodiments, water cooling of the apparatus 1''' is necessary but is purposely not illustrated so as to simplify the illustration of the apparatus performing in the manner described above.

One device under actual test comprised a combustion chamber 11 of five-eighth inch diameter and of a length of four inches. The single passage 64 delivering the high pressure products of combustion to the expansion bore 52 of nozzle 50 was of a diameter of five-thirtyseconds of an inch, while the diameter of the nozzle expansion bore 52 was seven-sixteenths of an inch. As a result, the area ratio between the transfer passage 64 to the nozzle and the nozzle bore passage was nearly eight to one. Highly effective operation without deposit of the melted particles on the bore wall of nozzle 50 was achieved with combustion pressure within chamber 11 of about 250 psig using pure oxygen and No. 2 fuel oil continuously flowing to the combustion chamber via tubes 12, 13.

Important to an appreciation of this embodiment is the nature in which the hot products of combustion gases enter from chamber 11 into the large diameter expansion bore 52 of nozzle 50 asymmetrically via the single inclined passage 64 or its equivalent relative to the stream of particles 68 which pass into the large diameter bore 52 axially at the end of that bore upstream from passage 64. It should be appreciated that the feed of particulate material, as at 60, could be asymmetrical relative to a flow of the products of combustion which could enter axially at the upstream end of the large diameter expansion bore 52 of nozzle 50 via the passage 54, i.e. the powder inlet hole. In any case, since the conditions are such that a supersonic flow occurs with the pressure in the vicinity of the powder inlet being subatmospheric, the flow of the particles is centered relative to the high velocity expansion gas stream and is maintained at the core or center of that stream so as not to build up on the bore wall when the particles are molten prior to leaving the nozzle at exit 62. As may be appreciated, it would be difficult to feed the solid rod material into such sub-atmospheric, overexpanded gas stream 18 asymmetrically except under conditions of my copending application Ser. No. 583,474, filed Feb. 24, 1984, entitled "IMPROVED COMPRESSED AIR AND FUEL OPERATED FLAME SPRAY METHOD AND APPARATUS". In FIG. 3 of this application, a wire rod of solid material may be fed through particle inlet passage 54 in lieu of the solid material particles 68 with the apparatus acting in very similar manner to prevent build up on the wall of bore 52 in spite of the asymmetric introduction of the products of combustion via the single transfer passage 64 (or its equivalent).

Although the principles of the invention have been described using an oxy-fuel mixture and powder material in the embodiment of FIG. 3, they are equally applicable for an air-fuel mixture or for wire or rod feed rather than powdered solid material. Compressed air and fuel may be employed to permit the successful melting of the lower point materials such as aluminum, zinc, copper, and flame spraying of these materials at substantially reduced cost. Oxy-fuel mixtures or a mixture of compressed air with pure oxygen added thereto may be necessary when melting and spraying higher melting point materials such as stainless steel, mild steel, nickel, chrome alloys and the like.

Common to all embodiments of the present invention is the creation of a sub-atmospheric zone at the point of introduction of the material to be sprayed by selecting an area ratio of the nozzle expansion bore to the gas flow passage from the combustion chamber while maintaining a sufficiently high combustion chamber pressure to assure the over-expanded condition within the expansion chamber. In the FIG. 3 embodiment, no melted particle build up occurs on the expansion bore wall irrespective of symmetrical or asymmetrical introduction of the gases to the axially introduced material to be sprayed or, in the alternative, the axial introduction of the high pressure products of combustion to form the overexpanded, ultrasonic gas stream, into which material is fed asymmetrically.

While the invention has been particularly shown and described with reference to preferred embodiments thereof, it will be understood by those skilled in the art that variations in form and details may be made therein without departing from the spirit and scope of the invention.

What is claimed is:

1. A flame spray method comprising the steps of:

continuously combusting, under pressure, a continuously supplied compressed combustible gas and fuel mixture including oxygen within an internal burner combustion chamber, discharging the hot combustion product gases from at least one combustion chamber orifice through a single large diameter expansion chamber open at its downstream end to the atmosphere via an exit port while feeding material to be sprayed through said expansion chamber concurrently with said products of combustion by introduction of the material to the products of combustion outside of said combustion chamber, said large diameter chamber being sized in excess to the flow stream diameter of said products of combustion entering said chamber;

whereby, said material is heat softened or melted to form a spray for impact against a workpiece downstream of the exit port of said chamber after acceleration to high velocity by the flame jet comrpising said stream of products of combustion which pass through said chamber and exiting therefrom, and wherein said method further comprises controlling the operation of said internal burner and sizing the cross-sectional area of said at least one combustion chamber orifice relative to said exit port diameter of said expansion chamber, such that the pressure within said expansion chamber is maintained sub-atmospheric during operation.

2. The method as claimed in claim 1, wherein said combustible gas mixture comprises compressed air and said method further comprises the step of enriching said compressed air provided to said combustion chamber with a flow of pure oxygen.

3. The method as claimed in claim 1, wherein said material to be sprayed is a wire or powder, and said step of causing said material to pass through said large diameter, expansion chamber concurrently with the products of combustion comprises flowing said wire or powder axially relative to the jet comprised of the products of combustion.

4. The method as claimed in claim 1, wherein said expansion chamber comprises a converging chamber, and said step of passing said material concurrently with said products of combustion through said large diameter, expansion chamber comprises feeding multiple flows of material separately into and maintaining said flows seprate through said large diameter, converging chamber.

5. An improved flame spray apparatus for high deposition rate particle deposition on a substrate downstream of said apparatus to form a coating, said apparatus comprising:

an internal burner forming an essential closed combustion chamber, means for continuously combusting a flow of compressed air and fuel within said internal burner combustion chamber, a block closing off said combustion chamber having a relatively large diameter converging chamber terminating in an exit port opening outwardly of said block at one end thereof, products of combustion passage means within said block connecting said combustion chamber to said large diameter chamber and opening to said large diameter chamber, at the end opposite said exit port, at least one material feed passage means within said block opening to said large diameter chamber at the end of said chamber opposite that of said exit port, means for feeding a material to be sprayed onto said substrate through said material feed passage means, and wherein the diameter of said products of combustion passage means connecting said combustion chamber to said large diameter chamber and the minimum diameter of said large diameter chamber at said exit port are such that the pressure within said large diameter chamber is sub-atmospheric and said material to be melted is accelerated by the products of combustion passing through said large diameter chamber to high velocity and is melted to effect particle coating of said substrate at low cost, under extremely high deposition rates with the particles melting downstream of said large diameter chamber well after discharge from said at least one material feed passage means while preventing back flow of the products of combustion from the internal burner into said material feed passage means.

6. The apparatus as claimed in claim 5, wherein said material feed passage means comprises a single passage longitudinally through said block coaxial with said large diameter chamber.

7. The apparatus as claimed in claim 5, wherein said at least one material feed passage means comprises a plurality of inclined passages extending longitudinally through said block and converging towards the large diameter chamber.

8. The apparatus as claimed in claim 5, wherein said large diameter chamber is conical and converges in the direction of flow of the products of combustion therethrough.

9. The apparatus as claimed in claim 8, wherein said combustion products passge means connecting said combustion chamber to said conical large diameter chamber comprises a pair of side by side passages within said block at right angles and to opposite sides of said material feed passage means and opening at one end to said combustion chamber and wherein said combustion product passage means further comprises parallel inclined, converging holes within said block, to opposite sides and above and below said material feed passage means, equally spaced on the diagonal relative to said conical large diameter converging chamber having a common angle of inclination with the conical surface of said chamber and opening at respective ends, to said side by side passages and said large diameter chamber.

10. In a method of flame spraying utilizing an oxidant and fuel, and comprising the steps of burning said oxidant and fuel continuously at high pressure within a restricted combustion volume, conducting the products of combustion to the entrance of an elongate nozzle expansion bore through at least one intermediate passage, the improvement comprising; introducing the material to be sprayed into the entrance of said elongate nozzle expansion bore and selecting the corss-sectional areas of said elongate nozzle bore and said at least one intermediate passage, while controlling the level of pressure of combustion to produce a zone of sub-atmospheric pressure at the entrance to said elongate nozzle; whereby, the solid material is melted and sprayed at supersonic velocity as a result of overexpansion of the products of combustion within the elongate nozzle bore without melted particle build up on the bore wall.

11. The method as claimed in claim 10, wherein said solid material is introduced into the entrance of the elongate nozzle bore axially and said products of combustion are introduced into the elongate nozzle bore via said at least one intermediate passage asymmetric to the nozzle expansion bore.

12. The method as claimed in claim 10, wherein said combustion pressure is maintained at a minimum of 100 psig.

13. A flame spray apparatus comprising:

an internal burner having a restricted combustion volume, means for continuously delivering an oxidant and fuel to the restricted combustion volume of said internal combustion chamber for continuous combustion therein, an elongate nozzle mounted to said internal burner, said elongate nozzle including an elongate expansion nozzle bore, at least one intermediate gas transfer passage communicating said internal burner combustion chamber to the entrance of said elongate nozzle bore, a material feed passage opening to said elongate nozzle bore entrance, the cross-ectional areas of said elongate nozzle bore and said intermediate gas transfer passage being such that at predetermined elevated combustion pressure conditions within said combustion chamber, there is thereby produced during discharge of the products of combustion, a zone of sub-atmospheric pressure at the entrance of said elongate nozzle with said products of combustion overexpanded resulting in supersonic flow of the products of combustion as a result of passage through the elongate nozzle bore, and wherein one of said material passage and said at least one intermediate gas transfer passage open axially into the entrance of said elongated nozzle bore and the other of said passages opens asymmetrically to said bore at said entrance.

14. The apparatus as claimed in claim 13, wherein the ratio of the area of the elongate nozzle expansion bore to that of said at least one intermediate gas transfer passage communicating said combustion chamber to said elongate nozzle bore, at its entrance, is at least four to one.

* * * * *